US009283762B2

(12) United States Patent
Tamai et al.

(10) Patent No.: US 9,283,762 B2
(45) Date of Patent: Mar. 15, 2016

(54) DROPLET EJECTING APPARATUS AND DROPLET EJECTING METHOD

(71) Applicant: SEIKO EPSON CORPORATION, Tokyo (JP)

(72) Inventors: Takashi Tamai, Shiojiri (JP); Toshiyuki Suzuki, Matsumoto (JP); Masako Fukuda, Shiojii (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,792

(22) Filed: Sep. 15, 2014

(65) Prior Publication Data

US 2015/0097883 A1 Apr. 9, 2015

(30) Foreign Application Priority Data

Oct. 8, 2013 (JP) ..... 2013-210693

(51) Int. Cl.
*B41J 2/165* (2006.01)
*B41J 29/38* (2006.01)

(52) U.S. Cl.
CPC ..... *B41J 2/16508* (2013.01); *B41J 2/16526* (2013.01); *B41J 2/16538* (2013.01); *B41J 2002/16573* (2013.01)

(58) Field of Classification Search
USPC ..... 347/29, 33, 36, 9
See application file for complete search history.

(56) References Cited

U.S. PATENT DOCUMENTS

| | | | | |
|---|---|---|---|---|
| 8,177,315 | B2 | 5/2012 | Endo et al. | |
| 2007/0206046 | A1 * | 9/2007 | Koike et al. | 347/23 |
| 2008/0266343 | A1 * | 10/2008 | Borrell et al. | 347/14 |
| 2010/0220141 | A1 * | 9/2010 | Ozawa | 347/18 |

FOREIGN PATENT DOCUMENTS

| | | |
|---|---|---|
| JP | 2004-195749 | 7/2004 |
| JP | 2009-056742 | 3/2009 |
| JP | 2010-030184 | 2/2010 |
| JP | 2012-240237 | 12/2012 |

* cited by examiner

*Primary Examiner* — Jason Uhlenhake
(74) *Attorney, Agent, or Firm* — Workman Nydegger

(57) ABSTRACT

A droplet ejecting apparatus which includes a control unit which controls a recording operation in which dots are recorded on a medium by performing multipass recording in which recording of dots which are located in one main scanning line which goes along a main scanning direction is completed in a recording operation in the main scanning direction of N times (N is integer of 2 or greater), and a maintenance operation in which maintenance with respect to an ejecting unit is performed, in which the control unit performs a control so that at least recording operations in the main scanning direction of (N−1) times is performed between the previous maintenance operation and the subsequent maintenance operation when performing maintenance operations of a plurality of times.

7 Claims, 8 Drawing Sheets

DROPLET EJECTING APPARATUS AND DROPLET EJECTING METHOD

BACKGROUND

1. Technical Field

The present invention relates to a droplet ejecting apparatus.

2. Related Art

In a serial ink jet printer, dots are formed on a plurality of raster lines which are aligning in the sub-scanning direction by repeating a main scanning pass which forms the dots by ejecting ink from nozzles of a print head, and sub-scanning in which a medium is moved relative to the sub-scanning direction which intersects the main scanning direction while relatively moving the print head and the medium in the main scanning direction, and an image is printed on the medium. In addition, as a method of forming dots on the raster line, there is a single pass method in which forming of dots on a raster line is completed using one main scanning pass, and a multipass method in which forming of dots on the raster line is completed using main scanning passes of N times (N is integer of 2 or greater).

In the ink jet printer, there is a case in which ink is not ejected due to clogging of nozzles which is caused by thickening of ink, mixing of bubbles, or the like. When nozzles are clogged, dot omission occurs in an image, and deterioration of image quality is caused. Therefore, there is a case in which nozzle checking, cleaning of head (wiping, suction of ink, flushing, or the like) is performed in an ink jet printer in the related art, in order to suppress deterioration in image quality of an image which is caused by defective ejecting of ink from nozzles. For example, in JP-A-2010-30184, a technology is disclosed in which defective printing caused by an occurrence of a nozzle of which ejecting of ink is defective (hereinafter, referred to as "defective nozzle") is suppressed by executing a nozzle inspection even in the middle of printing, when the number of counting passes (corresponding to number of main scanning passes) in continuous printing exceeds a threshold value in the continuous printing in which printing is continuously performed with respect to a plurality of labels. At this time, as the threshold value of the number of counting passes, a small value is used in a printing mode of which a set reliability is high, and in contrast to this, a large value is used in a printing mode of which a set reliability is low. Accordingly, nozzle inspection timing is changed according to a set reliability of printing. In addition, hereinafter, as in the nozzle inspection, or head cleaning, a process of checking an ejecting state of a head, or a process of recovering the ejecting state of the head will be also referred to as a "maintenance process".

Here, in the ink jet printer, in order to suppress the above described deterioration in image quality of an image due to defective printing which is caused by defective nozzles, it is desirable to execute a maintenance process as much as possible even in the middle of printing. However, there is the following problem when executing a maintenance process in the middle of printing.

When executing a maintenance process in the middle of printing with respect to one medium, there is a possibility that a difference may occur in a forming state between a dot formed in a main scanning pass which is performed immediately before the maintenance process and a dot formed in a main scanning pass which is performed immediately after the maintenance process due to a stop time which is caused by the maintenance process, and deterioration in image quality due to color unevenness caused by the difference becomes obvious. For example, since a dot in the main scanning pass performed immediately before the maintenance process and a dot in the main scanning pass performed immediately after the maintenance process are mixed in a plurality of dots which are aligned on one raster line in the multipass method, there is a possibility that color unevenness due to mixing of dots may become obvious.

In addition, the above described problem is not a problem limited to a serial ink jet printer, and is a common problem in a droplet ejecting apparatus which records dots by ejecting droplets on a medium.

SUMMARY

The invention can be realized in the following forms.

(1) According to an aspect of the invention, there is provided a droplet ejecting apparatus which records dots on a medium which includes an ejecting unit which ejects droplets; and a control unit which controls a printing operation in which dots are recorded on the medium by performing multipass recording in which recording of dots which are located in one main scanning line which goes along a main scanning direction is completed in a recording operation in the main scanning direction of N times (N is integer of 2 or greater) by executing the recording operation in the main scanning direction in which dots are recorded by ejecting the droplets along the main scanning direction of the medium, and a sub-scanning operation in which the medium and the ejecting unit are relatively moved in a sub-scanning direction which intersects the main scanning direction, and a maintenance operation in which maintenance with respect to the ejecting unit is performed, in which the control unit performs a control so that at least recording operations in the main scanning direction of (N−1) times is performed between the previous maintenance operation and the subsequent maintenance operation when performing maintenance operations of a plurality of times. According to such a droplet ejecting apparatus, it is possible to perform maintenance processes by distributing the processes at a maintenance interval of main scanning pass of (N−1) times or more, during the printing operation which is executed using multipass recording which is completed in main scanning pass of N times. In this manner, it is possible to prevent color unevenness which occurs due to a maintenance process performed in the middle of a printing operation from becoming obvious, and to suppress deterioration in image quality of a printed image.

(2) In the droplet ejecting apparatus, the recording operation in the main scanning direction may be an operation in which the droplets are ejected from the ejecting unit while relatively moving the ejecting unit and the medium in the main scanning direction. In this case, it is possible to perform maintenance with respect to the ejecting unit which moves relative to the medium.

(3) In the droplet ejecting apparatus, a time for interrupting the printing operation due to the maintenance process of one time may be limited to be shorter than an allowed time, and a maintenance process of which a time needed in a completion is equal to or longer than the allowed time may be distributed into maintenance operations of a plurality of times which are equal to or shorter than the allowed time. It is possible to prevent color unevenness from becoming obvious which is caused when a maintenance operation equal to or longer than the allowed time is performed during a printing operation, and to suppress deterioration in image quality of a printed image.

(4) In the droplet ejecting apparatus, the control unit may control the printing operation using any one of a first mode in which a parameter N of the multipass recording is $N_1$ and a second mode in which the parameter N is $N_2$ ($N_2$ is integer greater than $N_1$), may control so that a recording operation in the main scanning direction of a first number of times of at least ($N_1-1$) times is executed between the previous maintenance operation and the subsequent maintenance operation in the first mode, and may control so that a recording operation in the main scanning direction of a second number of times of at least ($N_2-1$) times is executed between the previous maintenance operation and the subsequent maintenance operation in the second mode. According to such a droplet ejecting apparatus, it is possible to execute maintenance operations at an interval which is suitable for each mode by distributing the operations.

(5) In the droplet ejecting apparatus, the first number of times and the second number of times may be set to the same value. In this manner, it is possible to execute the maintenance operation in a distributing manner at regular intervals regardless of the mode, and to simplify the process.

(6) In the droplet ejecting apparatus, the maintenance process may include at least one of (i) a nozzle inspection in which a nozzle state of the ejecting unit is inspected, (ii) flushing in which droplets are idly ejected from the ejecting unit, and (iii) wiping in which a surface on which nozzles of the ejecting unit are provided is wiped. In this case, it is possible to prevent color unevenness which occurs due to at least one of maintenance processes of the nozzle inspection, flushing, and wiping which is performed in the middle of a printing operation from becoming obvious, and to suppress deterioration in image quality of a printed image.

(7) In the droplet ejecting apparatus, the droplets may be ink containing a resin. In this case, a droplet ejecting apparatus which uses the ink containing the resin is an apparatus which uses a structure in which ink is fixed onto a medium when a resin film is formed on the medium due to a cured resin, and ink is easily cured and clogged in the nozzle of the ejecting unit in the apparatus. Accordingly, in the droplet ejecting apparatus which uses the ink containing a resin, it is possible to suppress deterioration in image quality by effectively suppressing clogging of the nozzle of the ejecting unit, by executing a maintenance process in the middle of a printing operation.

In addition, the invention can be executed using various forms which are described below.

(a) A droplet ejecting apparatus and a droplet ejecting control device.
(b) A droplet ejecting method and a droplet ejecting control method.
(c) A computer program which executes the apparatus and device, and the methods.
(d) A non-temporary recording medium (non-transitory storage medium) in which the computer program which executes the apparatus and device, and the methods is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A1. Configuration of Printing Apparatus

Figure 1:
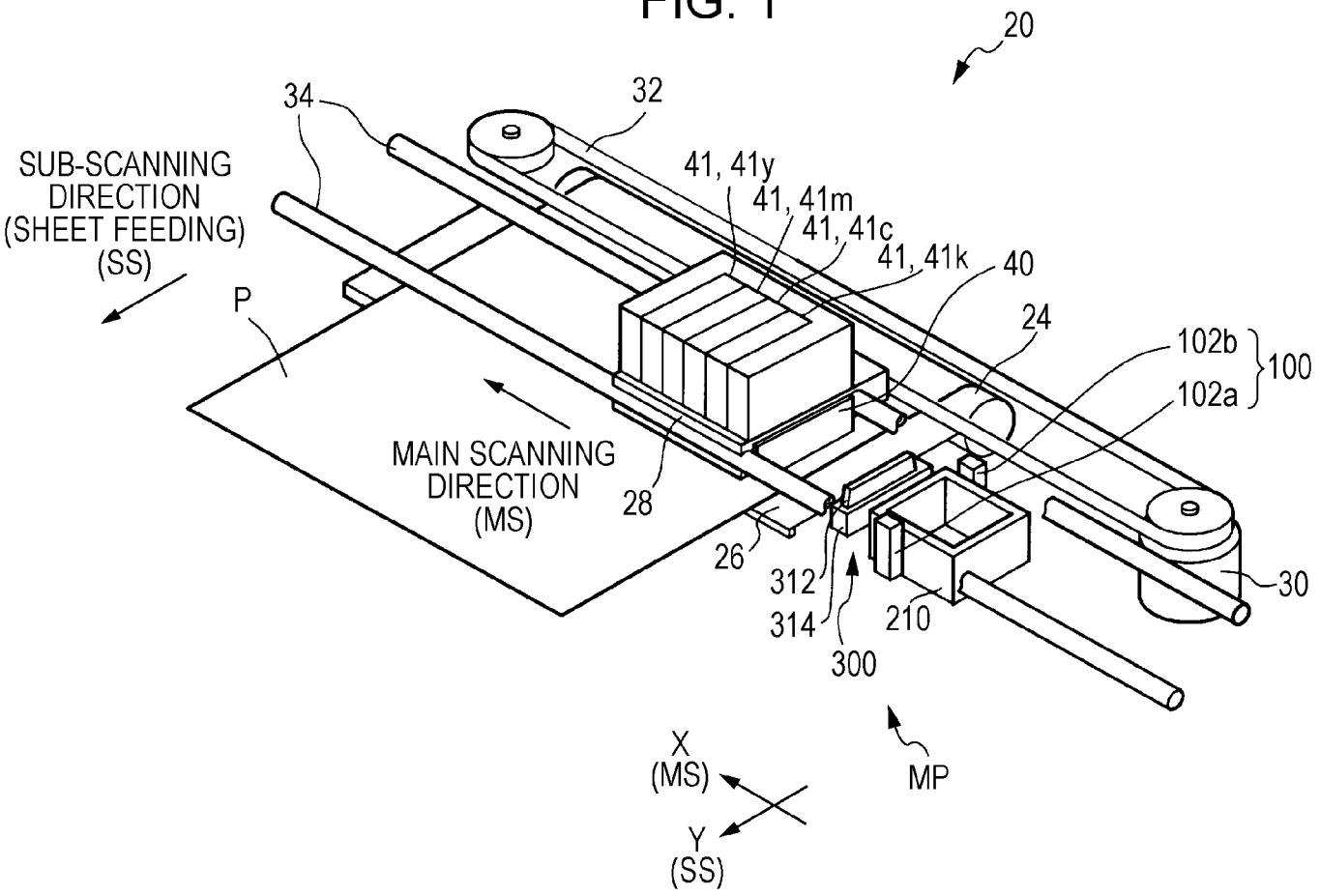
FIG. 1 is a schematic perspective view which illustrates a main configuration of a color ink jet printer as one embodiment of a droplet ejecting apparatus of the invention.

FIG. 1 is a schematic perspective view which illustrates a main configuration of a color ink jet printer 20 as one embodiment of a droplet ejecting apparatus in the invention. The printer 20 includes a sheet feeding roller 24 which is driven using a sheet feeding motor (not illustrated), a platen plate 26, a carriage 28, a carriage motor 30, a traction belt 32 which is driven by the carriage motor 30, and a guide rail 34 for the carriage 28. A print head 40 which includes a plurality of nozzles, and a plurality of ink cartridges 41 are mounted on the carriage 28. The print head 40 functions as an ejecting unit which ejects droplets. As the plurality of ink cartridges 41, specifically, an ink cartridge 41*k* of black ink, an ink cartridge 41*c* of cyan ink, an ink cartridge 41*m* of magenta ink, and an ink cartridge 41*y* of yellow ink are mounted.

A nozzle inspection unit 100 and an ink container 210 are provided at a maintenance position MP of the carriage 28 on the right end in FIG. 1. The nozzle inspection unit 100 includes light emitting element 102*a* and a light receiving element 102*b*, and inspects dot omission by inspecting a flight state of ink droplets which are ejected from nozzles using the light emitting element 102*a* and the light receiving element 102*b*. Details of the inspection using the nozzle inspection unit (hereinafter, also referred to as "nozzle inspection" or "dot omission inspection") will be described later. The ink container 210 also functions as an ink container for ink which is idly ejected from nozzles in the nozzle inspection, and in flushing which will be described later.

In addition, a wiper unit 300 is provided at a position between the ink container 210 and the platen plate 26. The wiper unit 300 includes a wiper blade 312 which is held by a wiper holding unit 314, and performs so-called wiping which wipes off dirt around nozzles of the print head 40. Details of the wiping using the wiping unit will be described later.

The carriage 28 moves in the main scanning direction along the guide rail 34 by being towed by the traction belt 32. The ink cartridge 41 and the print head 40 also move in the main scanning direction along with the movement of the carriage 28 in the main scanning direction. A printing sheet (medium) P is wound up by the sheet feeding roller 24 from a sheet stacker (not illustrated), and is sent to the sub-scanning direction on the surface of the platen plate 26. The main scanning direction is orthogonal to the sub-scanning direction. However, the sub-scanning direction and the main scanning direction are not necessarily orthogonal, and may intersect each other. In addition, a printing sheet is used as a medium. However, a medium of a material other than paper may be used. Specifically, a medium of a material such as cloth, or a vinyl chloride resin may be used.

Forming of dots on a main scanning line along the main scanning direction of the printing sheet P is executed when ink droplets are ejected from nozzles (to be described later) which are arranged in the print head 40 at the time of a movement of the print head 40 in the main scanning direction, after a movement of the printing sheet P in the sub-scanning direction (sheet feeding). In this manner, the movement of the print head 40 in the main scanning direction, and ejecting of ink droplets on the main scanning line are referred to as main scanning, and main scanning of one time is referred to as a "main scanning pass" or a "pass", simply. In addition, a movement of the printing sheet P in the sub-scanning direction is referred to as sub-scanning.

When the sub-scanning operation and the main scanning operation are alternately repeated, a plurality of raster lines which are configured of a plurality of dots which are aligned on the main scanning line along the main scanning direction are formed in line along the sub-scanning direction, and printing of an image on the printing sheet P is executed.

Figure 2:
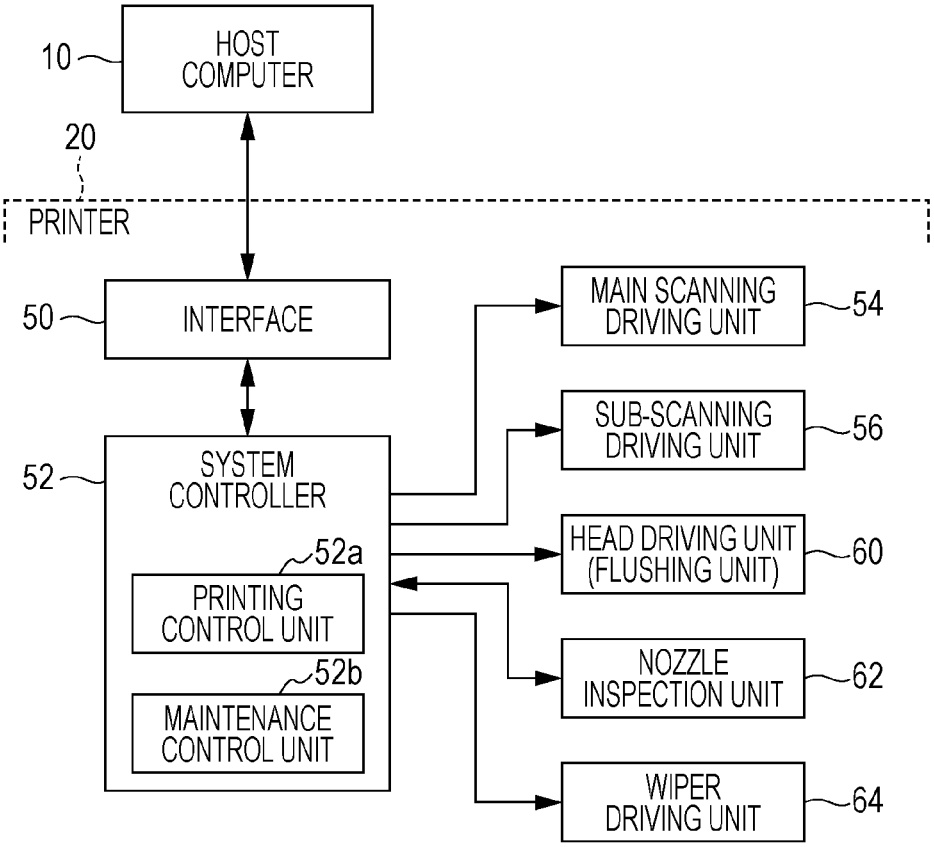
FIG. 2 is a block diagram which illustrates an electrical configuration of a printer.

FIG. 2 is a block diagram which illustrates an electrical configuration of the printer 20. The printer 20 includes an interface 50 which receives signals which are supplied from the host computer 10, and a system controller 52 which controls the entire operation of the printer 20. The system controller 52 can function as a printing control unit 52*a* and a maintenance control unit 52*b*. The system controller 52 functions as a control unit which controls various operations of the printer 20.

The system controller 52 is configured of a computer which includes a CPU (not illustrated), and a memory such as a ROM, a RAM, or the like, for example, a microcomputer. The system controller 52 functions as, for example, the printing control unit 52*a* and the maintenance control unit 52*b*, and controls operations of the main scanning driving unit 54, the sub-scanning driving unit 56, the head driving unit 60, a nozzle inspection driving unit 62, and a wiper driving unit 64.

The main scanning driving unit 54 drives a main scanning driving mechanism which is configured of the carriage motor 30, the traction belt 32, and the guide rail 34. The main scanning driving unit 54 executes a movement of the carriage 28 in the above described main scanning according to a control of the system controller 52 (printing control unit 52*a*), that is, a movement of the print head 40 in a printing operation. In addition, the main scanning driving unit 54 executes a movement of the print head 40 to a maintenance position MP according to a control of the system controller 52 (maintenance control unit 52*b*) in a maintenance operation.

The sub-scanning driving unit 56 drives as sub-scanning driving mechanism which is configured of the sheet feeding motor (not illustrated) and a sheet feeding roller 24. The sub-scanning driving unit 56 executes a movement of the printing sheet P (sheet feeding) in the above described sub-scanning according to a control of the system controller (printing control unit 52*a*). However, the sub-scanning operation may be an operation in which the print head 40 is moved instead of the printing sheet P.

The head driving unit 60 drives nozzles which are provided in the print head 40 according to printing data which is transferred from the host computer 10, according to a control of the system controller 52 (printing control unit 52*a*), and executes forming of dots corresponding to the printing data by performing ejecting of ink droplets in the above described main scanning in the printing operation. The head driving unit 60 performs idle ejecting of ink from nozzles at the above described maintenance position MP according to a control of the system controller 52 (printing control unit 52*b*), and executes ejecting of ink droplets, and bubbles or ink of which viscosity is increased from nozzles, that is, flushing, in the maintenance operation. Accordingly, the head driving unit 60 also functions as a flushing unit. In addition, "idle ejecting" means ejecting which is performed for an object other than the original use of ink droplets (that is, printing).

The nozzle inspection driving unit 62 executes an inspection of nozzles, which will be described later, according to a control of the system controller 52 (maintenance control unit 52*b*). In addition, the wiper driving unit 64 executes wiping, which will be described later, according to a control of the system controller 52 (maintenance control unit 52*b*).

Figure 3:
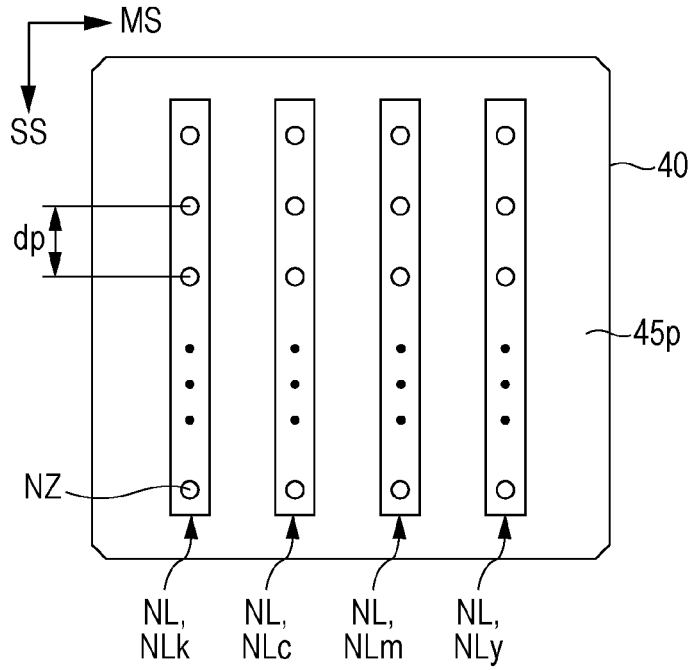
FIG. 3 is an explanatory diagram which illustrates an example of a configuration of nozzles which are provided in a print head.

FIG. 3 is an explanatory diagram which illustrates an example of a configuration of nozzles which are provided in the print head 40. A nozzle column NLk of black ink, a nozzle column NLc of cyan ink, a nozzle column NLm of magenta ink, and a nozzle column NLy of yellow ink are provided on the lower face (hereinafter, also referred to as "nozzle face") 45*p* of the print head 40. In addition, when a color is not specifically distinguished in the following descriptions, the nozzle column will be simply referred to as a "nozzle column NL". Each nozzle column NL includes a plurality of nozzles NZ which are aligned in the sub-scanning direction SS at a constant nozzle pitch. The sub-scanning direction SS illustrates relative movement directions of the printing sheet P and the print head 40. According to the embodiment, a nozzle pitch dp and a pixel pitch in the sub-scanning direction on the printing sheet P are the same. However, it is also possible to set the nozzle pitch dp to integral multiplication which is twice or more of the pixel pitch in the sub-scanning direction on the printing sheet P. In a case of the latter, so-called interlace printing (recording method in which dots are formed after the second pass on another main scanning line which is present between main scanning lines on which dots are formed in the first pass) is executed.

A2. Outline of Printing Operation

Figure 4:
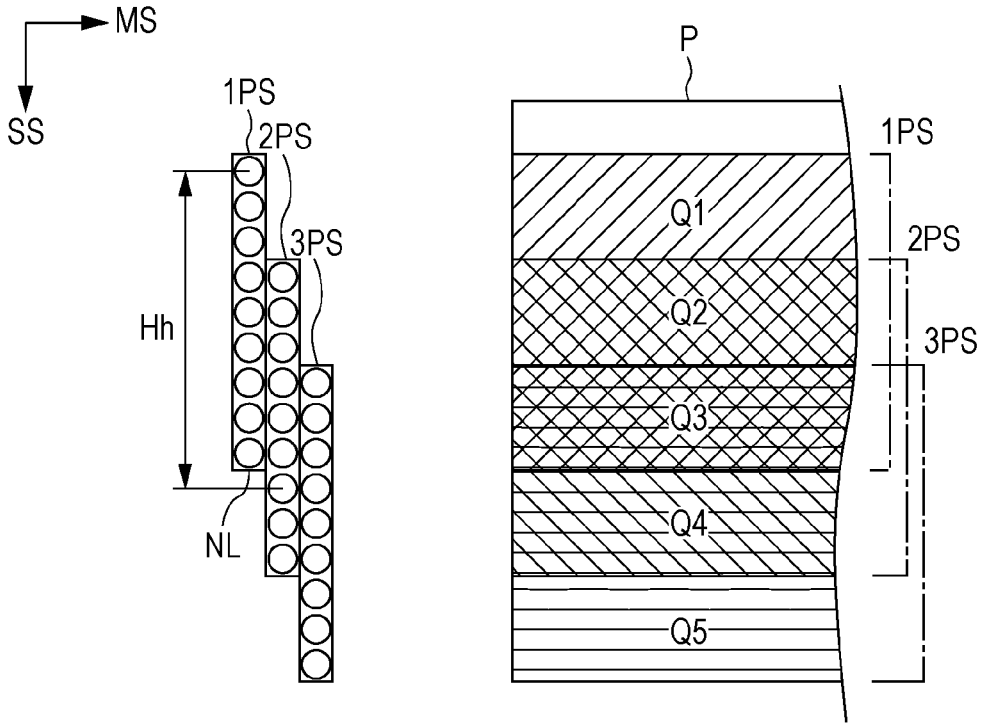
FIG. 4 is an explanatory diagram which illustrates printing using multipass recording.

The printing operation is an operation in which dots are recorded on a medium. FIG. 4 is an explanatory diagram which illustrates printing using multipass recording. In the figure, positions of nozzle columns NL in three main scanning passes, and printing regions in the positions are illustrated. In addition, for ease of illustration, a state in which the print head 40 moves in the sub-scanning direction SS with respect to the printing sheet P is illustrated.

Here, the "multipass recording" means a dot recording method in which forming of dots on an individual main scanning line (raster line) is completed in main scanning passes of N times (N is integer of 2 or greater), and is also referred to as "multipass printing". In the example in FIG. 4, a case is illustrated in which the number of passes N of multipass recording (hereinafter, also referred to as "multipass number N") is three. The positions of the respective nozzle columns NL are deviated in the sub-scanning direction by a distance corresponding to ⅓ of the height Hh of the head in the first pass (1PS), the second pass (2PS), and the third pass (3PS). Here, the "height Hh of the head" means a distance which is denoted by mxdp (m is the number of nozzles of the nozzle column NL, and dp is nozzle pitch). In the example in FIG. 4, a state in which the number of nozzles m is set to nine, and three nozzles are deviated in the sub-scanning direction in every main scanning pass is illustrated.

Here, a case in which dots are formed in the entire pixel of the printing sheet P using ink of a single color (for example, cyan ink) has been described as an example. In the first pass, forming of dots is executed in regions Q1 to Q3. In the second pass, forming of dots is executed in regions Q2 to Q4. In the third pass, forming of dots is executed in regions Q3 to Q5. Since main scanning passes of three times are executed on the individual main scanning line, dot recording in the entire pixel position on each main scanning line is not executed, and only a part thereof is executed in each main scanning pass. In addition, dot recording in the entire pixel position on each main scanning line is completed at a point of time in which main scanning passes of three times is completed on each main scanning line. In addition, in the specification, the term "dot recording" means "executing forming or non-forming of dots".

A3. Outline of Maintenance Operation

The maintenance operation means an operation in which a maintenance process is executed. At least one maintenance process among three maintenance processes of a nozzle inspection, flushing, and wiping are included in the maintenance process with respect to the print head 40. These maintenance processes are executed when there is a request for maintenance at various timings such as at a time of start-up or shut-off of the printing apparatus, or when there is an instruction for maintenance regularly, or through a button (not illustrated) by a user at a time of not performing printing, for example. In addition, there are requests for maintenance at various timings during the printing, and a corresponding maintenance process is executed as will be described later. Here, details of each maintenance process will be described.

Figure 5:
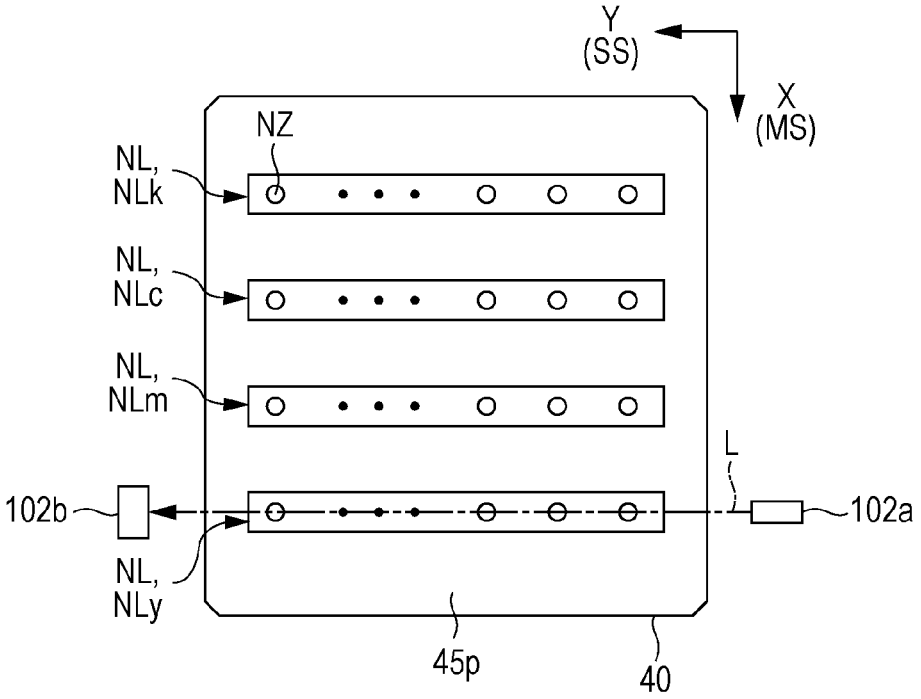
FIG. 5 is a schematic view which describes an inspection of each nozzle using a nozzle inspection unit.

(1) Nozzle inspection: FIG. 5 is a schematic view which describes an inspection of each nozzle NZ using the nozzle inspection unit 100. The light emitting element 102*a* and the light receiving element 102*b* are arranged on both sides of the print head 40 by interposing the print head therebetween. The head driving unit 60 (FIG. 2) drives each nozzle of the nozzle column NLy one by one, and sequentially in each predetermined driving period, and causes each nozzle to sequentially eject ink droplets using idle ejecting, in a state in which the print head 40 is positioned at a position in which the nozzle column NLy comes to the upper side of an optical path of the laser light L. Since the ink droplets which are ejected block the optical path of the laser light L on the way, light receiving in the light receiving element 102*b* is temporarily stopped. Accordingly, since the laser light L is temporarily shielded in the light receiving element 102*b* when ink droplets are normally ejected from a certain nozzle, it is possible to determine that the nozzle is not clogged. In addition, when the laser light L is not shielded at all in a driving period of a certain nozzle, it is possible to determine that the nozzle is clogged.

In addition, it is also possible to use another inspection method except for such an optical inspection as the nozzle inspection. For example, when an actuator of a nozzle is a piezoelectric element, an inspection method in which whether or not ink droplets can be normally ejected from each nozzle is inspected by measuring residual vibration after providing vibration to the piezoelectric element may be adopted.

Figure 6:
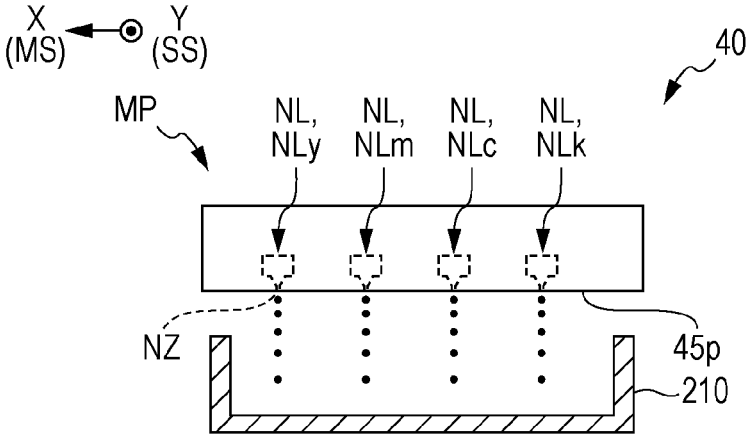
FIG. 6 is a schematic view which describes a flushing process of each nozzle of the print head.

(2) Flushing: FIG. 6 is a schematic view which describes a flushing process of each nozzle NZ of the print head 40. In the flushing process, the head driving unit 60 executes idle ejecting of ink droplets by driving each nozzle NZ.

Figure 7A:
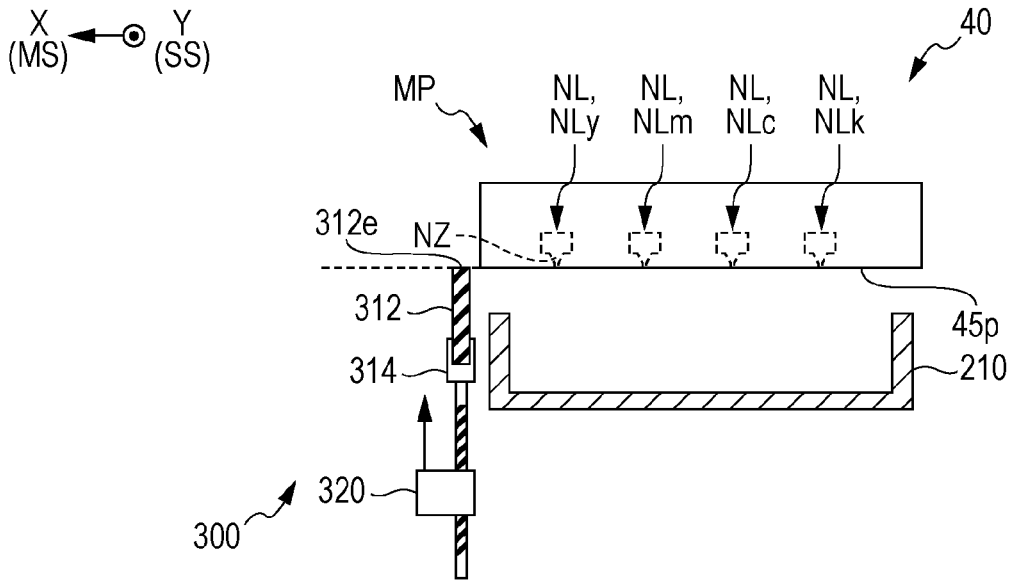
FIGS. 7A and 7B are schematic views which describe a wiping process of a nozzle face of the print head using a wiper unit.
Figure 7B:
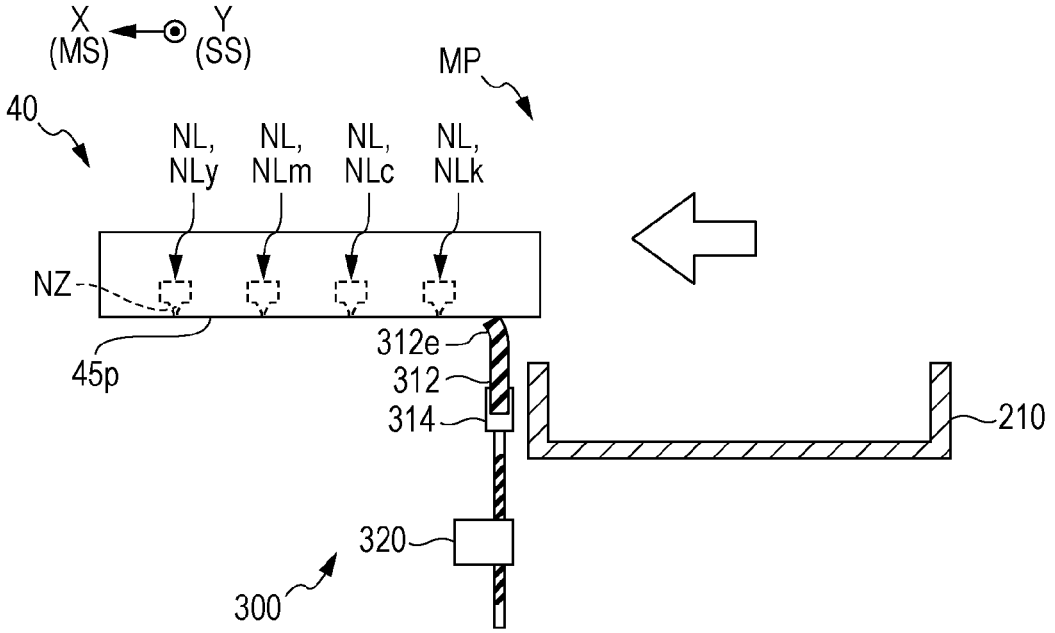

(3) Wiping: FIGS. 7A and 7B are schematic views which describe a wiping process of the nozzle face 45*p* of the print head 40 using the wiper unit 300. In addition, the nozzle face is a face on which nozzles are provided. There is a case in which the nozzle face 45P is contaminated since thickened ink adheres to an opening portion of a nozzle. In addition, there is a case in which an ink blot adheres to the nozzle face 45P when the nozzle face is in contact with an end face of the ink container 210. When blots are accumulated on the nozzle face 45P, a performance of the print head 40 deteriorates. In the wiping process, it is possible to wipe off blots on the nozzle face 45P using a tip end portion 312*e* of a wiper blade 312 by moving the print head 40 in the arrow X direction (main scanning direction MS).

A4. Maintenance Operation During Printing Operation

Figure 8:
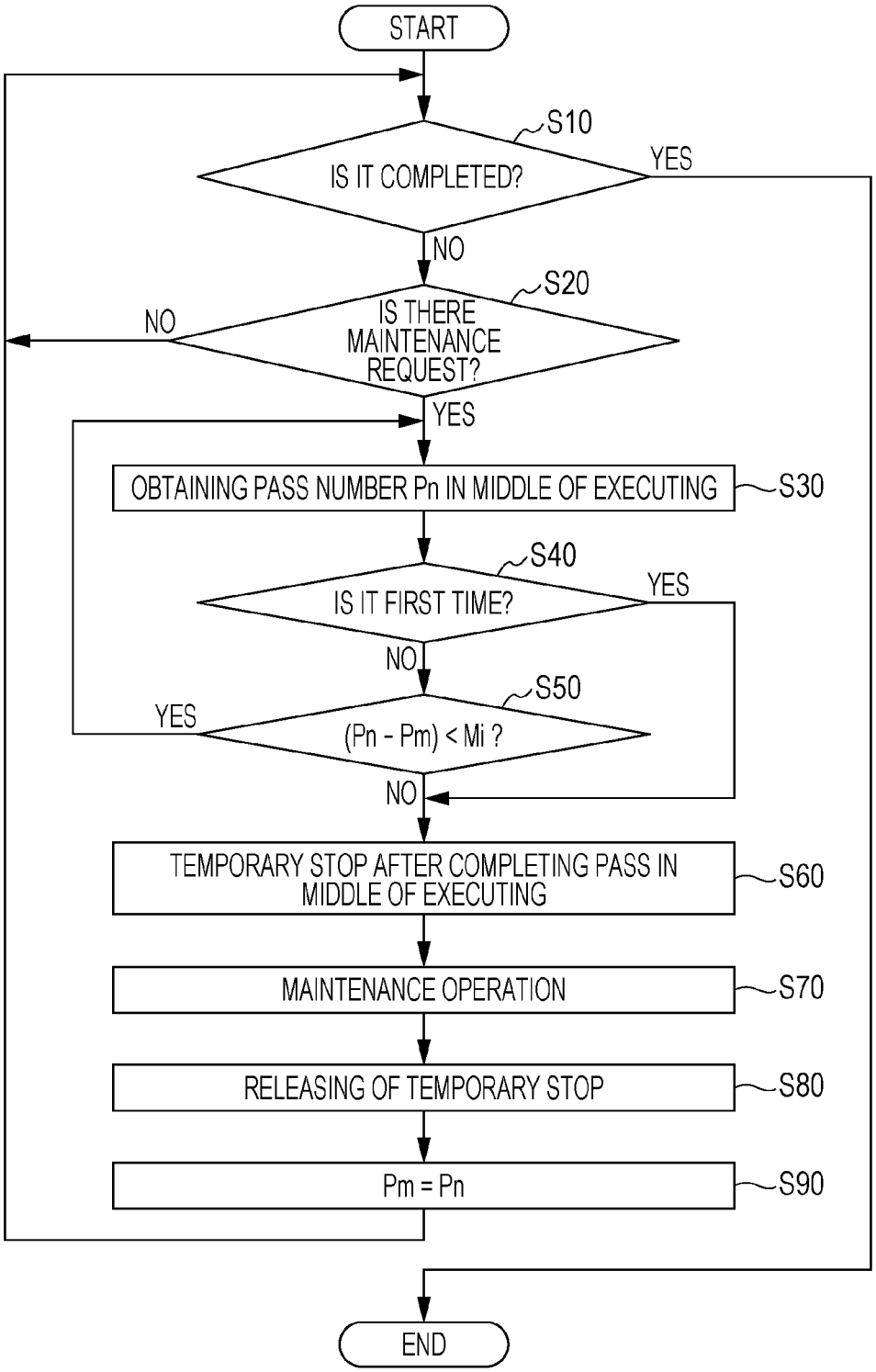
FIG. 8 is an explanatory diagram which illustrates managing order of a maintenance operation when executing the maintenance operation in a printing operation.

FIG. 8 is an explanatory diagram which illustrates managing order of the maintenance process when executing the maintenance process during a printing operation on a medium of one sheet. The maintenance control unit 52*b* (refer to FIG. 2) starts managing of maintenance which is illustrated in FIG. 8 along with a start of a printing operation due to the above described multipass recording, and repeatedly executes processes of steps S20 to S90 until the printing operation on the medium of one sheet is completed (Yes in step S10).

In step S20, the process stands by until there is an execution request for at least one maintenance process among the above described plurality of maintenance processes, and a determination on "there is a request for maintenance" is made during the printing operation. When there is a request for a maintenance process, a pass number (number of passes) Pn (Pn is integer of 1 or more) of the main scanning pass which is currently executed is obtained from the printing control unit 52*a* (step S30). As the maintenance execution request, for example, an execution request of any one maintenance process of the nozzle inspection, the flushing, and the wiping is appropriately made according to a set managing schedule. In addition, it is preferable to set a time Tm for stopping printing (hereinafter, referred to as "stop time Tm") for maintenance of one time so as to be shorter than a limit time Tr which is determined in advance. The limit time Tr is set by taking into consideration an influence on an occurrence of color unevenness due to stopping of printing. For this reason, a maintenance process which needs a longer time than the limit time Tr is executed by being distributed into a plurality of maintenance operations. For example, it is assumed that a time which is needed in inspections of a plurality of nozzles which are provided in the print head becomes longer than the limit time Tr. Therefore, in the nozzle inspection, it is possible to perform the inspection by distributing the inspection into a plurality of operations in which inspections of a predetermined number of nozzles are performed. In addition, when the printing apparatus includes a plurality of print heads, inspection operations may be performed in each of the predetermined number of print heads with respect to the flushing or the wiping. In the specification, one operation which is performed in the limit time Tr is referred to as a "maintenance operation". In addition, a process which is performed corresponding to one maintenance request is referred to as a "maintenance process". Accordingly, a maintenance process of one time is completed through one maintenance operation, or a plurality of maintenance operations.

In step S40, when the maintenance request which is made is the first request during the printing operation on the medium of one sheet, the process proceeds to step S60 which will be described later. In contrast, when the maintenance request which is made is not the first request during the printing operation on the medium of one sheet, whether or not $(Pn-Pm)<Mi$ is satisfied is determined (step S50). Here, Pm is a pass number of the main scanning pass which is executed immediately before the previous maintenance operation. In addition, Mi is a threshold value for determining whether or not a sufficient number of passes are executed between the pass numbers of Pn and Pm, and it is preferable to set Mi to a value equal to or greater than (N−1) (N is number of multipass). Hereinafter, (Pn−Pm) will be referred to as "passed pass number". When the number of passed passes (Pn−Pm) is less than the interval Mi, the process returns to step S30, and steps S30 to S50 are repeated. On the other hand, when the passed pass number (Pn−Pm) is equal to the interval Mi, the process proceeds to step S60, and a temporary stop of the printing operation after finishing the main scanning pass of the pass number Pn which is currently executed is instructed with respect to the printing control unit 52*a*. In addition, in the printing control unit 52*a* in which stopping of the printing operation is instructed, the printing operation at a point of time in which the currently executed main scanning pass is ended is temporarily stopped.

The threshold value Mi for the passed pass number (Pn−Pm) is determined based on an execution time of the nozzle inspection, or various maintenance execution times such as a flushing execution time. In addition, the value of the threshold value Mi may be set based on the constant number of passes which are set in advance, the number of passes corresponding to a printing region which is set in advance, or the like. In addition, the value of the threshold value Mi may be set so that maintenance of one time or more is executed in the middle of printing.

The maintenance control unit 52*b* executes a requested maintenance operation after the temporary stop of the printing operation (step S70). As described above, the stop time Tm for one maintenance operation is set so as to be shorter than the predetermined limit time Tr. A release of the temporary stop of the printing operation is instructed with respect to the printing control unit 52*a* after the maintenance operation (step S80). The printing control unit 52*a* in which the release of the temporary stop of the printing operation is instructed restarts a printing operation from the subsequent main scanning pass. In addition, the maintenance control unit 52*b* sets Pm=Pn (step S90), and repeatedly executes processes in steps S10 to S90 until the printing operation on the medium of one sheet is completed.

In the flow in FIG. 8, the reason that the maintenance operation is set to be executed when the passed pass number (Pn−Pm) becomes equal to the threshold value Mi is to prevent the maintenance operation from being excessively concentrated in a short period. That is, since the maintenance operation is not executed until the passed pass number (Pn−Pm) becomes equal to the threshold value Mi even when there is a maintenance request, there is no case in which the maintenance operation is excessively concentrated in a short period. As described above, it is preferable that the threshold value Mi be set to a value equal to or greater than (N−1) (N is multipass number), however, the reason is as follows. That is, in the multipass recording, dot recording on an individual main scanning line is completed using main scanning pass of N times. At this time, when the threshold value Mi is set to the value equal to or greater than (N−1), only a maintenance operation of one time at maximum is performed in a period from the start to the end of dot recording on the individual main scanning line. Accordingly, it is possible to suppress passing through of an excessively long time period from the start to the end of the dot recording on the individual main scanning line. As a result, it is possible to obtain an effect that color unevenness can be suppressed. In addition, when the stop time Tm for maintenance operation of one time is limited to the limit time Tr or less, it is possible to further increase the effect. In addition, when the multipass number N is 2, since the threshold value Mi is to be set to 1, it is also possible to execute the maintenance operation in every main scanning pass of one time. However, also in this case, it is possible to suppress passing through of an excessively long time between recording timing of a certain dot and recording timing of another dot on the individual scanning line, when the stop time Tm for maintenance operation of one time is set to be shorter than the predetermined limit time Tr. However, as the threshold value MI, it is preferable to set a value to be equal to or greater than 2, regardless of the multipass number N. In this manner, it is possible to further increase the effect of suppressing color unevenness, since a time interval in the maintenance operation can be further widely secured. In addition, it is preferable that the threshold value Mi is set to a value which is less than the number of times of the main scanning pass which is executed in the printing operation on the medium of one sheet. In this manner, it is possible to execute the maintenance operation of at least one time during the printing operation on the medium of one sheet.

According to the above described managing order of the maintenance process, intervals of a main scanning pass of Mi (≥N−1) times are necessarily provided from one maintenance operation to the subsequent maintenance operation. For this reason, for example, even when there is a maintenance request which is executed by being distributed into a plurality of times as in the above described nozzle inspection, the plurality of maintenance operations are executed by being distributed, since the intervals of the main scanning pass of Mi times are necessarily provided until the subsequent maintenance operation is performed after one maintenance operation is performed.

Figure 9:
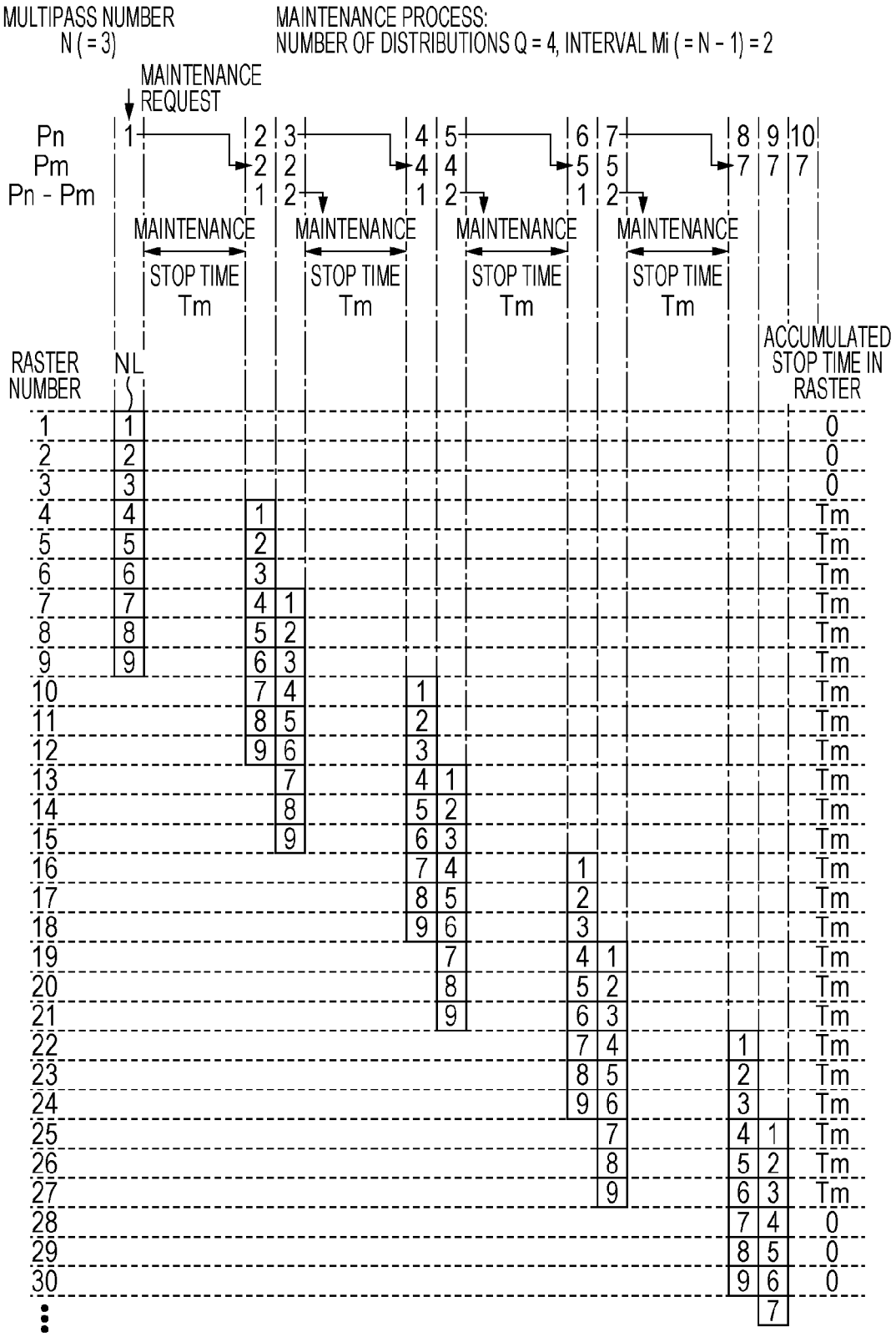
FIG. 9 is an explanatory diagram which illustrates a case in which a plurality of maintenance processes are distributed as an example.
Figure 10:
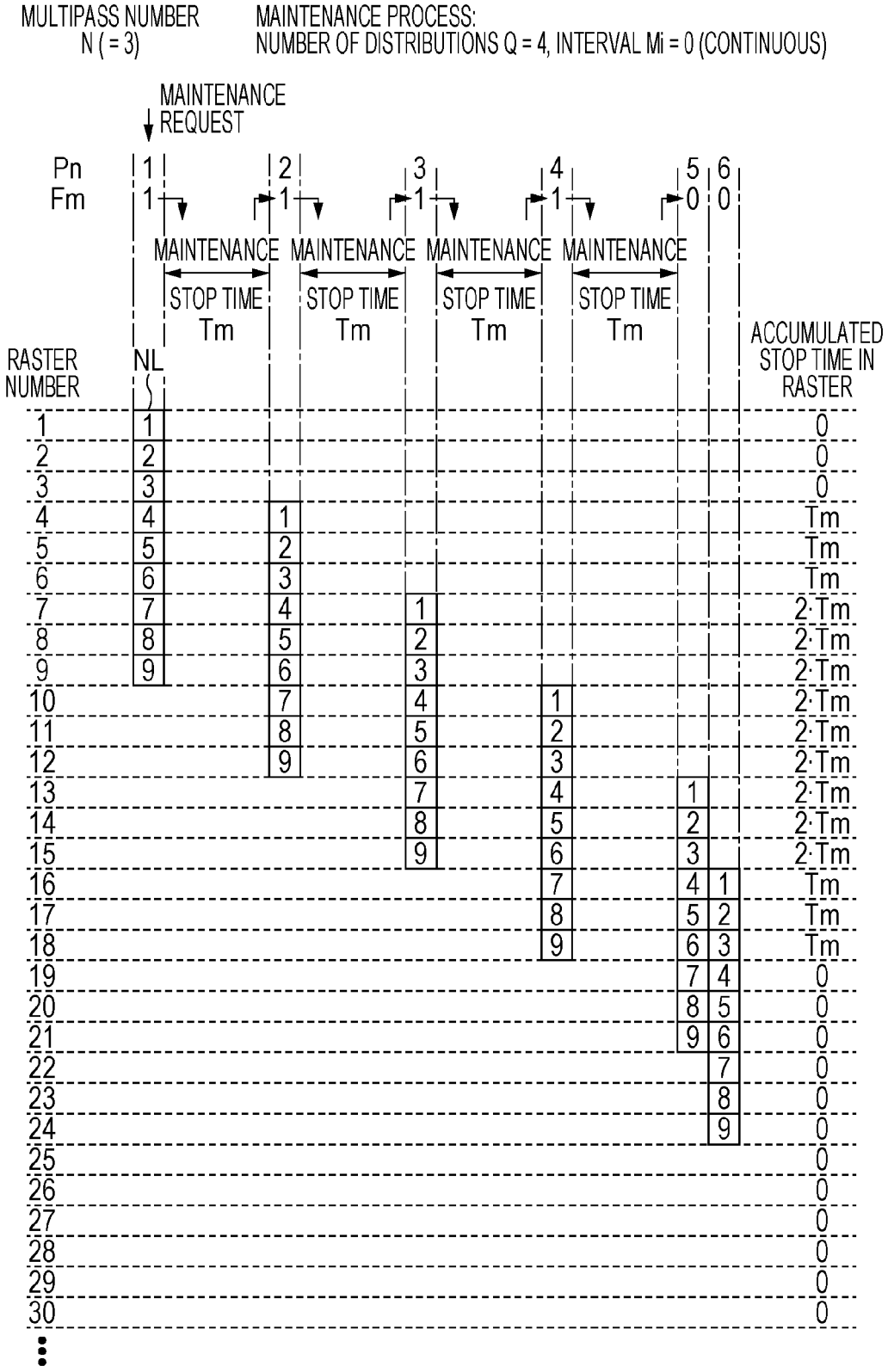
FIG. 10 is an explanatory diagram which illustrates a case in which a plurality of maintenance processes are not distributed as a comparison example.

FIG. 9 is an explanatory diagram which illustrates a case in which a plurality of maintenance operations are distributed as an example. FIG. 10 is an explanatory diagram which illustrates a case in which a plurality of maintenance operations are not distributed as a comparison example. In the example in FIG. 9, a case is illustrated in which, in a multipass printing of which multipass number is 3, a maintenance process of which a number of distributions Q is 4 (maintenance operation which is executed by being distributed into 4 times) is requested in the middle of executing a main scanning pass of Pn=1, and the interval Mi is set to 2 (=N−1). In the comparison example in FIG. 10, a case is illustrated in which, in a multipass printing of which multipass number is 3, a maintenance process of which the number of distributions Q is 4 is requested in the middle of executing a main scanning pass of Pn=1, similarly to the example, and maintenance operations of four times are executed once between each of main scanning passes without setting the interval Mi, that is, with the interval Mi of zero. In addition, all of the stop times Tm in each of maintenance operations are set to be the same for ease of description.

In the comparison example (FIG. 10), the maintenance operations of Q (=4) times are sequentially executed after completing each main scanning pass of Pn=1 to 4. In this case, stop times of (N−1)×Tm(=2×Tm) are accumulated between main scanning passes of N(=3) times in raster lines of raster numbers of 7 to 15. For this reason, since a difference in forming state occurs between dots which are respectively formed in the main scanning passes of N times in these raster lines as described in the problem, color unevenness which goes along the main scanning direction due to this easily attracts attention. In addition, since the raster lines in which stop times of (N−1) times are accumulated are continued over a plurality of lines along the sub-scanning direction, color unevenness which goes along the sub-scanning direction also easily attracts attention. Accordingly, in a case of the comparison example, there is a possibility that places in which color unevenness occurs may be concentrated and easily attract attention, and deterioration in image quality may become obvious.

In contrast to this, in the example (FIG. 9), maintenance operations are executed by being distributed with intervals of Mi (=N−1=2), after completing each main scanning pass of Pn=1, 3, 5, and 7. In this case, only one time of stop time Tm occurs, during the respective main scanning passes of N(=3) times on the raster lines of raster numbers of 7 to 26, and stop times are not accumulated. For this reason, a considerable difference occurs between the forming state of dots in the main scanning pass immediately before the execution of the maintenance process and the forming state of dots in the main scanning pass immediately after the execution of the maintenance process in these raster lines, however, since the difference in the forming state of dots between the main scanning passes which are continuously executed without performing the maintenance operation becomes small, the occurrence of color unevenness is distributed. As a result, it is possible to suppress deterioration in image quality by preventing color unevenness from becoming obvious compared to that in the comparison example. In addition, in the above described embodiment, the example of the printing operation on a medium of one sheet has been described, however, the invention can be applied to a printing operation in one printing job. For example, when a medium has a roll shape, the invention is applied to a printing operation in one printing job.

B. Modification Example (1) In the above described embodiment, the limit time Tr of the printing stop time Tm for the maintenance operation has been described as a time which is set by taking an influence on a printing time into consideration. Meanwhile, the limit time Tr may be a time which is set as follows.

As described in the problem, there has been a problem in that there is a difference in the forming state between the dots which are formed in the main scanning pass immediately before the maintenance operation and the dots which are formed in the main scanning pass immediately after the maintenance operation due to the interrupted time (stop time Tm) in the maintenance operation, color unevenness which is caused by the difference becomes obvious, and the image quality deteriorates. Therefore, the limit time Tr may be set based on an allowed time which is a time in which deterioration in image quality falls in an allowable range even when the printing operation is interrupted. In this manner, it is possible to suppress deterioration in image quality by suppressing the difference in the forming state between the dots which are formed in the main scanning pass immediately before the maintenance operation and the dots which are formed in the main scanning pass immediately after the maintenance operation, and by preventing the color unevenness which is caused by the difference from becoming obvious. In addition, the allowed time is obtained by checking a time in which deterioration in image quality falls in an allowable range even when printing operation is interrupted in advance. In addition, the allowed time may be set based on an input by a user.

(2) In the above described embodiment, the printing apparatus which performs printing in which the multipass number is N has been described. In contrast to this, in a printing apparatus which performs multipass printing, there is a printing apparatus which includes a first mode in which the multipass number is $N_1$, and a second mode in which the multipass number is $N_2$ ($N_2$ is integer larger than $N_1$), and can perform printing by switching to any one of the first mode and the second mode. In such a printing apparatus, the following may be performed.

An interval in a maintenance operation in the first mode in which the multipass number is $N_1$ may be set to $Mi_1$ which is an interval of a main scanning pass number equal to or greater than ($N_1$−1), an interval $Mi_2$ in a maintenance operation in the second mode in which the multipass number is $N_2$ may be set to equal to or greater than ($N_2$−1), and the intervals $Mi_1$ and $Mi_2$ in the two modes may be set to values which are different from each other. In this case, it is possible to execute maintenance operations by distributing the operations at an appropriate interval in each of the first and second modes.

In addition, the interval $Mi_1$ of the maintenance operation in the first mode may be set to the same interval as that of the interval $Mi_2$ of the maintenance operation in the second mode. In this manner, it is possible to execute the maintenance operation at a constant interval in the middle of printing by distributing the operation regardless of the mode, and to make processes simple.

In addition, in a printing apparatus which includes, instead of two modes, three or more modes with different multipass numbers, respective maintenance operations may be executed by being distributed by setting an appropriate interval of a maintenance operation in respective modes, and may be executed by distributing the maintenance operations in the respective modes at an interval of a mode in which the multipass number is the largest, regardless of the mode.

(3) In the above described embodiment, the printing apparatus in which three maintenance processes of the nozzle inspection, the flushing, and the wiping as the maintenance processes can be executed in the middle of printing has been described. In contrast to this, it is possible to apply the invention to a printing apparatus which can execute at least one of a nozzle inspection, flushing, and wiping as maintenance, such as a printing apparatus which can execute two of flushing and wiping, a printing apparatus which can execute two of a nozzle inspection and flushing, and a printing apparatus which can execute only flushing.

(4) In the above described embodiment, the serial printing apparatus in which the print head moves in the main scanning direction has been described, however, the invention can also be applied to a printing apparatus in which dot recording can be executed over the whole width (whole length of main scanning line) of a medium along the main scanning direction in a state in which the print head is stopped. In this case, it is preferable that a movement of a medium (or print head) in the sub-scanning direction (sub-scanning) be executed, though a movement of the print head (or medium) in the main scanning direction (main scanning) is not performed. In addition, it is possible to execute approximately the same multipass recording as that in the embodiment also in this case.

There are an apparatus which does not perform a movement in the main scanning direction of a print head or a medium, and an apparatus which performs the movement, however, dot recording which is performed on the main scanning line can be referred to as a "recording operation in the main scanning direction" in both the apparatuses. That is, in the apparatus in which main scanning of the print head is not performed, the "recording operation in the main scanning direction" is an operation in which dot recording on the main scanning line is executed in a state in which the print head is stopped with respect to a medium. On the other hand, in the apparatus in which main scanning of the print head is performed, the "recording operation in the main scanning direction" is an operation in which dot recording on each main scanning line is executed while relatively moving the print head and a medium in the main scanning direction. This operation corresponds to a main scanning pass. In other words, the recording operation in the main scanning direction is a recording operation in the main scanning direction in which dots are recorded by ejecting droplets along the main scanning direction of the medium. In addition, in other words, the above described multipass recording is recording in which recording of dots which are located on one main scanning line in the main scanning direction is completed in recording operations in the main scanning direction of N times (N is integer of 2 or greater).

(5) In the above described embodiment, ink which will be used is not particularly limited, and it is possible to apply the invention to a printing apparatus which uses various types of ink. For example, applying to a printing apparatus in which ink containing a resin (resin-based ink) is used is effective. For example, resin-based ink such as resin ink containing an aqueous binder (specific polymer) which cures at a low temperature uses a structure in which ink is fixed onto a medium by being cured at a low temperature (usually, approximately 40° C. to 60° C.), and by forming a resin film on the medium, and easily gets stuck in nozzles of a print head by being cured. For this reason, in a printing apparatus in which resin-based ink is used, it is effective to perform a maintenance process even in the middle of printing, in order to prevent deterioration in image quality by suppressing clogging of nozzles of the print head. In addition, it is possible to apply the invention to a printing apparatus in which various types of inks are used without being particularly limited to resin-based ink.

(6) In the above described embodiment, the printing apparatus which performs multipass recording in which forming of dots is completed using main scanning passes of N times (N is integer of 2 or greater) on the raster line (main scanning line) has been described. It is also possible to apply the invention to a printing apparatus which performs interlace printing which is a printing method in which a raster line on which forming of dots is not performed is interposed between raster lines on which forming of dots is completed in main scanning passes of N times, along with the multipass recording.

(7) In the above described embodiment, the printing apparatus which ejects ink on the printing sheet has been described, however, it is possible to apply the invention to various apparatuses which record dots by ejecting droplets on a medium.

Such an apparatus is referred to as a liquid ejecting apparatus, a droplet ejecting apparatus, or the like. In addition, the droplets mean a state of liquid which is ejected from the liquid ejecting apparatus, and includes a granular shape, a tear shape, or a thread shape leaving a trail. In addition, the liquid here may be a material which can be ejected by the liquid ejecting apparatus. For example, the material may include a material in a state of liquid phase, materials which flow such as a liquid state having high or low viscosity, sol, gel water, and an inorganic solvent, an organic solvent, a solution, a liquid resin, liquid metal (metallic melt) other than that, or materials in which particles of a functional material which is formed of a solid body such as a pigment or metal particles are melted, diffused, or mixed in a solvent, not only liquid as a state of the material. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, or the like. Specific examples of the liquid ejecting apparatus may be a liquid ejecting apparatus which ejects liquid including a material such as an electrode material, or a color material which is used when manufacturing, for example, a liquid crystal display, an electroluminescence (EL) display, a surface emission display, a color filter, or the like, in a form of dispersion or dissolution. In addition, the liquid ejecting apparatus may be a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. Further, the liquid ejecting apparatus may adopt a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye lens (optical lens) which is used in an optical communication element, or the like, onto a substrate, and a liquid ejecting apparatus which ejects etching liquid such as an acid or alkali in order to etch a substrate or the like.

The invention is not limited to the above described embodiments or modification examples, and can be executed as various configurations without departing from the scope of the invention. For example, the embodiment corresponding to technical features in each embodiment which is described in the summary of the invention, and technical features in the modification examples can be appropriately substituted or combined in order to solve a part or all of the above described problems, or in order to achieve a part or all of the above described effects. In addition, the technical feature can be appropriately deleted when the feature is not described in the specification as an essential feature.

The entire disclosure of Japanese Patent Application No. 2013-210693, filed Oct. 8, 2013 is expressly incorporated by reference herein.

What is claimed is:

1. A droplet ejecting apparatus which records dots on a medium comprising:

an ejecting unit which ejects droplets; and a control unit which controls a printing operation in which dots are recorded on the medium by performing multipass recording in which recording of dots which are located in one main scanning line which goes along a main scanning direction is completed in a recording operation in the main scanning direction of N times (N is an integer of 2 or greater) by executing the recording operation in the main scanning direction in which dots are recorded by ejecting the droplets along the main scanning direction of the medium, and a sub-scanning operation in which the medium and the ejecting unit are relatively moved in a sub-scanning direction which intersects the main scanning direction, and a maintenance operation in which maintenance with respect to the ejecting unit is performed, wherein the control unit performs a control so that a predetermined number equal to at least recording operations in the main scanning direction of (N−1) times is performed between the previous maintenance operation and the subsequent maintenance operation when performing maintenance operations of a plurality of times, wherein a time for interrupting the printing operation due to the maintenance process of one time is limited to be shorter than an allowed time, wherein a maintenance process of which a time needed for completion is equal to or longer than the allowed time is distributed into maintenance operations of a plurality of times which are equal to or shorter than the allowed time.

2. The droplet ejecting apparatus according to claim 1, wherein the recording operation in the main scanning direction is an operation in which the droplets are ejected from the ejecting unit while relatively moving the ejecting unit and the medium in the main scanning direction.

3. The droplet ejecting apparatus according to claim 1, wherein the control unit can control the printing operation using any one of a first mode in which a parameter N of the multipass recording is $N_1$ and a second mode in which the parameter N is $N_2$ ($N_2$ is integer larger than $N_1$), controls so that a recording operation in the main scanning direction of a first number of times of at least $(N_1-1)$ times is executed between the previous maintenance operation and the subsequent maintenance operation in the first mode, and controls so that a recording operation in the main scanning direction of a second number of times of at least $(N_2-1)$ times is executed between the previous maintenance operation and the subsequent maintenance operation in the second mode.

4. The droplet ejecting apparatus according to claim 3, wherein the first number of times and the second number of times are set to the same value.

5. The droplet ejecting apparatus according to claim 1, wherein the maintenance process includes at least one of (i) a nozzle inspection in which a nozzle state of the ejecting unit is inspected, (ii) flushing in which droplets are idly ejected from the ejecting unit, and (iii) wiping in which a surface on which nozzles of the ejecting unit are provided is wiped.

6. The droplet ejecting apparatus according to claim 1, wherein the droplets are ink containing a resin.

7. A droplet ejecting method comprising:

performing a printing operation in which dots are recorded on a medium by performing multipass recording in which recording of dots which are located in one main scanning line which goes along a main scanning direction is completed in a recording operation in the main scanning direction of N times (N is integer of 2 or greater) by executing the recording operation in the main scanning direction in which dots are recorded on the medium by ejecting droplets from an ejecting unit along the main scanning direction of the medium, and a sub-scanning operation in which the medium and the ejecting unit are relatively moved in a sub-scanning direction which intersects the main scanning direction; and performing a maintenance operation in which maintenance with respect to the ejecting unit is performed; and controlling the recording operations in the main scanning direction such that a predetermined number equal to at least the recording operations in the main scanning direction of (N−1) times is performed between the previous maintenance operation and the subsequent maintenance operation when performing maintenance operations of a plurality of times, wherein a time for interrupting the printing operation due to the maintenance process of one time is limited to be shorter than an allowed time, wherein a maintenance process of which a time needed for completion is equal to or longer than the allowed time is distributed into maintenance operations of a plurality of times which are equal to or shorter than the allowed time.

* * * * *